US005741082A

United States Patent [19]

Toya

[11] Patent Number: 5,741,082

[45] Date of Patent: Apr. 21, 1998

[54] TAPE PRINTERS HAVING CUTTER CONTROL

[75] Inventor: Masumi Toya, Akishima, Japan

[73] Assignee: Casio Computer Co., Ltd., Tokyo, Japan

[21] Appl. No.: 714,224

[22] Filed: Sep. 16, 1996

[30] Foreign Application Priority Data

Sep. 19, 1995 [JP] Japan ..... 7-240042

[51] Int. Cl.[6] ..... B41J 11/70

[52] U.S. Cl. ..... 400/615.2; 400/593; 400/621

[58] Field of Search ..... 400/586, 615.2, 400/593, 621

[56] References Cited

U.S. PATENT DOCUMENTS

| | | | |
|---|---|---|---|
| 4,968,165 | 11/1990 | Karube et al. | 400/593 |
| 5,295,753 | 3/1994 | Godo et al. | 400/615.2 |
| 5,409,317 | 4/1995 | Ueno et al. | 400/615.2 |
| 5,447,383 | 9/1995 | Hirono et al. | 400/615.2 |

*Primary Examiner*—John S. Hilten

*Attorney, Agent, or Firm*—Frishauf, Holtz, Goodman, Langer & Chick

[57] ABSTRACT

In a tape printer which prints text data including characters/symbols on a tape, there is a fixed distance between a position where a thermal head is provided and a position where a cutter cuts a printed tape portion. For first text data to be printed, a margin is set and then the data is printed on the tape. Thereafter, the next text data is input with a margin being set and printed on the tape. When the printing of the first text data ends, the operation of the printer stops. When the printing is continued after the next data is input with a margin being set, the tape is conveyed by a length equal to the sum of the margins and set for the respective first and second text data and the input next data is printed. When the boundary between the margins arrives at the position of the cutter during the printing of the next text data, the printing of the next text data is interrupted and a tape portion on which the previous text data has been printed is cut by the cutter from the remaining tape. Thereafter, the printing of the next text data restarts.

6 Claims, 9 Drawing Sheets

PRINTING HEAD POSITION (P)
CUTTER POSITION (P)
30
18
32
L
(L > X > Y > 0)

L
L-X
X

100
T1

A B C D
Y
X

A B C D
T1
30a
Y

E F
A B C D
T2
X
X

E F G H
T2
T2
30b

E F G H
a
Y
Y

TAPE PRINTERS HAVING CUTTER CONTROL

BACKGROUND OF THE INVENTION

The present invention relates to tape printers, which print on a tape text data including characters, symbols, etc.

Conventionally, there are tape printers which print index labels which adhere to audio/video cassettes and name labels which adhere to our various belongings.

A tape printer of this type prints input text data of characters/symbols on a tape along its length, and cuts the printed tape portion from the remaining tape with a cutter to form an index or name label.

In this tape printer, the cutter is provided at a position spaced from and downstream of a thermal head of the printing unit in the direction of conveyance of the tape. In this case, a blank unprintable portion of the tape corresponding to the distance between the thermal head and the cutter would be produced between the leading end of the tape and the position on the tape where the data starts to be printed.

Generally, when text data is to be printed on a tape, a blank or margin is provided at each of the leading and trailing ends of the printing data. Thus, all of the margin is not used vainly, but at least a portion of the tape corresponding to the difference in length between the blank or margin produced necessarily due to the structure of the tape printer and a margin set by the user would be useless, which will be described in more detail below.

FIGS. 9A–9E show a printing process performed by the conventional tape printer. Reference numeral 1 denotes a tape; "P" a position where a plurality of heating elements of the thermal head is disposed in a single line across the tape. Reference character C denotes a position where the cutter is disposed.

Before the printing starts, as shown in FIG. 9A, the leading end 2 of the tape 1 is at the cutter position C. Before the printing, the length of margins provided before and after the data to be printed is set by the keyed-in data within the distance L between the positions P and C. Reference character a of FIG. 9A denotes the length of a margin of the tape 1 set before the leading end of the tape 1. Reference character b denotes a length of the tape to be discarded as a useless portion, which is calculated on the basis of the distance L between the positions P and C and the length a of the leading margin.

FIG. 9B shows text data during printing. At the position P, the thermal head prints text data one line at a time on the tape 1, which is then conveyed in the direction of arrow K. When the distance of conveyance of the tape 1 arrives at the unnecessary margin length b after the text data starts to be printed on the tape 1, the tape 1 is stopped and the printing is interrupted.

As shown in FIG. 9C, the cutter is then driven to cut the unnecessary portion 3 from the tape 1. As a result, a margin 4 having the length a is ensured at the leading end of the tape 1.

Thereafter, as shown in FIG. 9D, the printing restarts to thereby print characters "ABC" on the tape 1.

As shown in FIG. 9E, when the end character "C" of the text data has been printed, the tape 1 is conveyed by a length (a+L) which includes the length of the margin a set beforehand at the trailing end of the tape 1 and the distance L between the points C and P to ensure the trailing end margin 5. The cutter is then driven to cut and separate the printed tape portion 6 from the remaining tape 1. Thus, a label (printed tape portion having the leading and trailing margins 4 and 5 having a desired length) 6 is obtained.

When the next label is to be produced, text data is input, the lengths of leading and trailing ends are set and the printing process, as shown in FIGS. 9A–9E, is performed.

As described above, in the conventional tape printer, the printing process shown in FIGS. 9A–9E is performed, so that each time text data is printed, an unnecessary margin 3 is produced to thereby consume the corresponding part of the tape uselessly.

SUMMARY OF THE INVENTION

It is therefore an object of the present invention to provide a tape printer which eliminates useless consumption of a part of a tape when text data is to be printed.

According to the present invention, the above object is achieved by a tape printer comprising:

- input means for inputting text data and command information;
- margin setting means for setting a margin at each of the leading and trailing ends of the text data when the text data is printed on a tape;
- print means for printing the text data input by the input means on the tape with a printing head while conveying the tape;
- cutter means provided at a position spaced a predetermined distance from and downstream of the printing head in the direction of conveyance of the tape;
- calculation means for calculating a position where the operation of the print means is interrupted, on the basis of the length of the margin set by the margin setting means and the distance between the printing head and the cutter means; and
- control means for stopping the operation of the print means when the printing of one text data input by the input means ends; for interrupting the operation of the print means on the basis of data on the position calculated by the calculation means during the time when other text data input by the input means then continues to be printed by the print means to drive said cutter means to thereby cut and separate the tape portion on which the one-text data is printed from the remaining tape; for restarting the printing of the remaining other text data, the printing of which has been interrupted; and for stopping the operation of the print means when the printing of the other text data ends.

Even when the text data input by the input means has been printed on the tape, and hence a predetermined length of the tape has been conveyed, the printed tape portion is not immediately cut and separated. When the next text data is printed, the conveyance and printing of the tape is interrupted at a predetermined position and the previously printed tape portion is cut and separated from the remaining tape to thereby produce no useless tape portion between the previous printed text data and the next text data to be printed.

According to the present invention, the tape printer may further comprises second control means responsive to command information to drive the cutter means being input to the printer after the printing of the text data ends for driving the cutter means after the print means has conveyed the tape.

In the inventive printer, the control means drives the cutter means after the tape on which the text data has been printed has been conveyed in response to a command to drive the cutter means being input to the printer after the text data has been printed. Thus, when there is no next text data to be printed after the previous text data has been printed, the printed portion of the previous text data is conveyed downstream of the cutter means and cut by the cutter means from the remaining tape in accordance with the input tape cut command.

As described above, according to the inventive tape printer, when a plurality of text data is printed successively, a useless quantity of tape does not increase to thereby perform economic printing.

DESCRIPTION OF THE PREFERRED EMBODIMENTS

Figure 1:
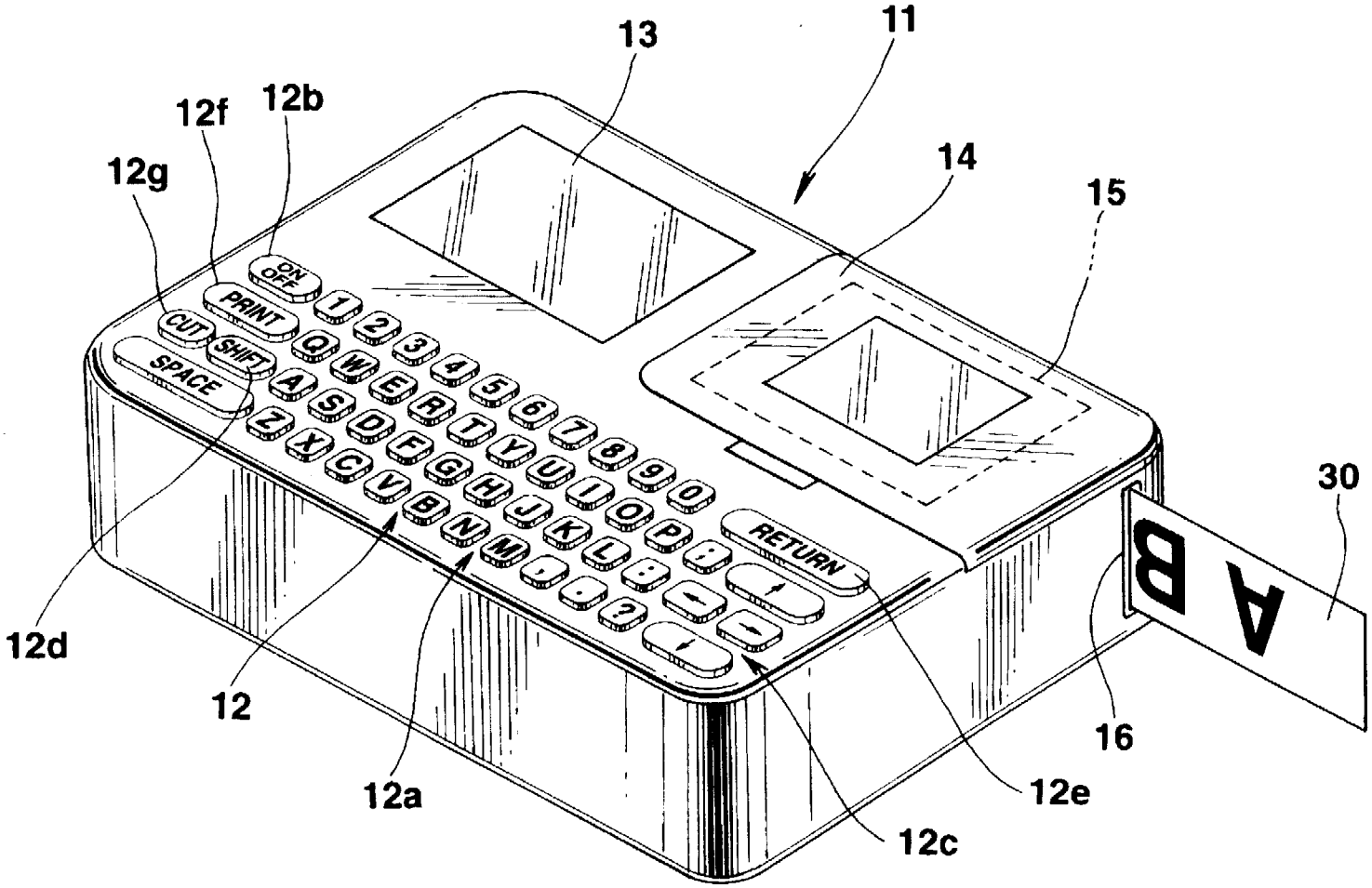
FIG. 1 is a perspective view of a tape printer as an embodiment of the present invention.

FIG. 1 is a perspective view of a tape printer as an embodiment of the present invention. As shown in FIG. 1, a keyboard 12, a liquid crystal display 13, and a cassette accommodating space 15 closed by an operable cover 14 are provided on an upper surface of the printer body 11.

The keyboard 12 is provided with character input keys 12*a* which include alphabetical keys, numeral keys, and symbol keys; a power supply key 12*b*; cursor keys 12*c* which move a cursor displayed on the display 13; a shift key 12*d* which switches between a capital and a small letter to be used; a return key 12*e* which is operated to fix the input or selected data and to command the starting of a predetermined function; a print key 12*f* operated to print input text data; and a cutter key 12*g* operated to cut and separate the whole printed input text data tape portion from the remaining tape.

Reference numeral 16 denotes a tape exit from which the printed tape 30 is discharged outside the printer body 11.

Figure 2:
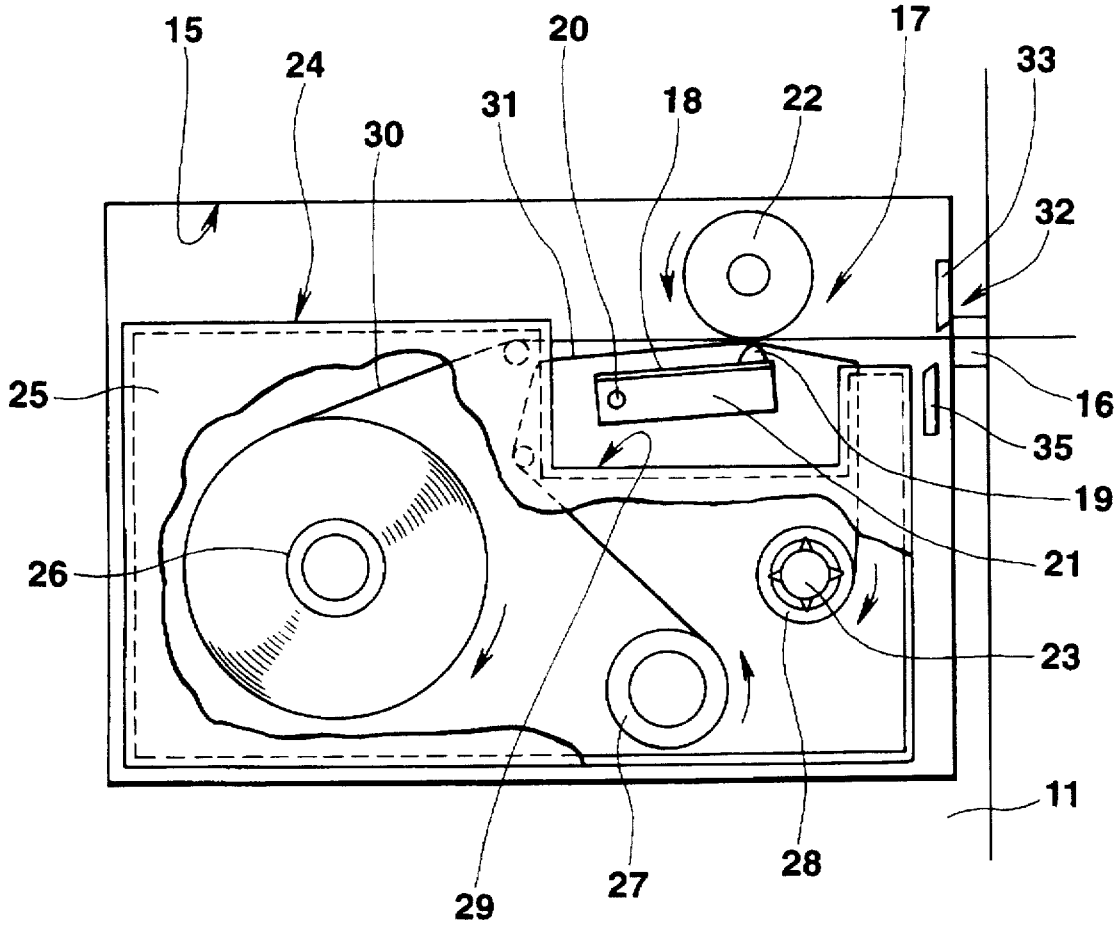
FIG. 2 is a plan view of a cassette accommodating space in the body of the tape printer.

FIG. 2 illustrates the inside of the cassette accommodating space 15 viewed by opening the top cover 14 on the printer body 11. Within the cassette accommodating space 15 is a printing unit 17 including a thermal printer.

A tape cassette 24 which contains a printing tape 30 and a thermal transfer ink ribbon 31 is set in the cassette accommodating space 15.

The printing unit 17 is provided with a thermal (or printing) head 18 which produces heat and is driven on the basis of the input text data, a platen roller 22 and an ink ribbon winding shaft 23 which are rotated when the thermal head 18 is driven to convey the tape 30 and ink ribbon 31, respectively.

The thermal head 18 is provided with a plurality of heating elements 19 arranged in a line across the tape 30 and attached to a support 21 which is turnable around a shaft 20. The thermal head 18 is turned around the shaft 20 in conjunction with the opening/closing operation of the cover 14 by a mechanism (not shown) to engage with and disengage from the platen roller 22. As shown in FIG. 2, when the cover 14 is closed for printing, the thermal head 18 is caused to press the tape 30 and ink ribbon 31 against the platen roller 22. When the cover 14 is opened, the thermal head 18 is disengaged from the platen roller 22 to allow the tape cassette 24 to be exchanged.

The platen roller 22 is rotated only counterclockwise by a predetermined angle by a conveyance driver to be described later in more detail each time the thermal head 18 prints data for a line and conveys the tape 30 and ink ribbon 31 by a predetermined distance. Simultaneously with the rotation of the platen roller 22, the ink ribbon winding shaft 23 is rotated only clockwise by the conveyance driver (not shown) to wind therearound the ink ribbon 31 thermally transferred by the thermal head 18.

The conveyance driver for the platen roller 22 and ink ribbon winding shaft 23 is similar to that used in the conventional tape printer. For example, it is provided with a driving source such as a stepping motor, its driving circuit and a gear-train transmission mechanism which transmits the rotation of the driving source to the platen roller 22 or ink ribbon winding shaft 23.

The tape cassette 24 set in the cassette accommodating space 15 is provided with a case 25, a tape supply reel 26 around which a printing tape 30 is wound, an ink ribbon supply reel 27 around which a thermal transfer ink ribbon 31 is wound, and an ink ribbon winding reel 28 which is rotated by the winding shaft 23. The cassette case 25 has a recess 29 in which the thermal head 18 is accommodated. The tape 30 and ink ribbon 31 are drawn from the cassette case 25 and set between the thermal head 18 and the platen roller 22 in the accommodating space 29.

The printing tape 30 is composed of a synthetic resin sheet having a printing surface and a back on which an adhesive is coated, and a peelable paper strip adhering to the adhesive on the back of the resin sheet.

A cutter 32 is provided adjacent to the tape exit 16 within the cassette accommodating space 15.

Figure 3:
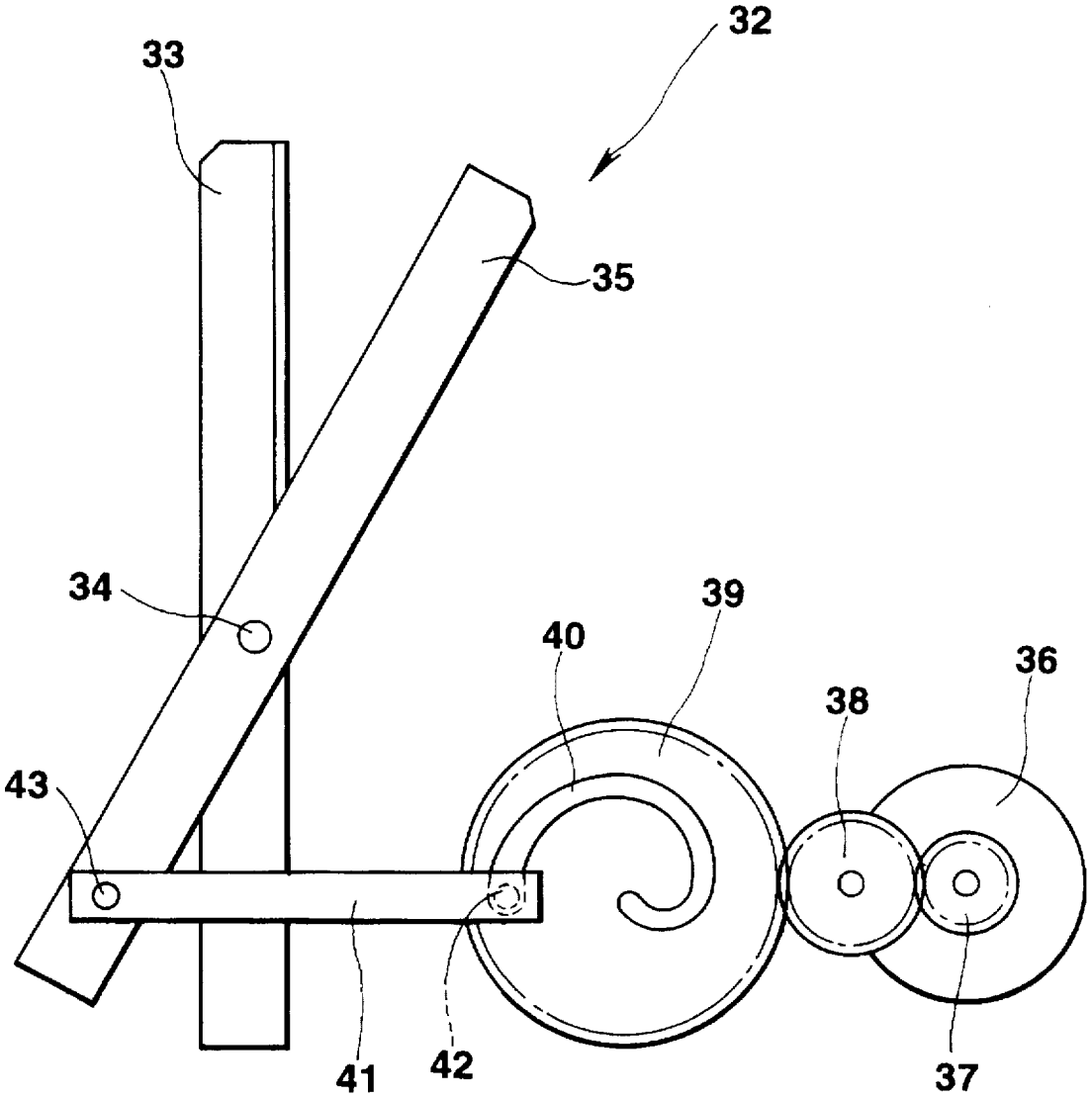
FIG. 3 illustrates the structure of a tape cutter of the tape printer.

FIG. 3 shows one example of the cutter 32, which takes the form of a pair of scissors having an edged blade 33 fixed to the printer body 11 and a movable edged blade 35 attached rotatably at 34 to the fixed blade 33. A driving mechanism for the cutter 32 is provided with an DC motor 36, gears 37, 38, 39; a cam 40 and an arm 41. By a one-directional rotation of the DC motor 36, the gear 37 rotates in that direction to rotate the gears 38 and 39 and hence to turn a cam 40 provided on a side of the gear 39. The arm 41 has at one end a short engaging projection 42 which is engaged in a helical groove in the cam 40. The arm 41 is connected at the other end via a pivot 43 to the movable edged blade 35, so that as the cam 40 rotates, the movable edged blade 35 is turned toward the fixed edged blades 33 around the shaft 34 to cut the tape 30. Thereafter, the DC motor 36 and hence the cam 40 rotate in the reverse direction to return the movable edged blade 33 to its original position.

When text data is printed by the printing unit 17 of FIG. 2, the tape 30 and the ink ribbon 31 are conveyed at the same speed by the platen roller 22 and ribbon winding reel 28, respectively, the thermal head 18 presses the tape 30 and ink ribbon 31 against the platen roller 22 to perform the sequential thermal transfer operation and hence sequentially print the text data on the tape 30. The printed tape 30 is discharged via the tape exit 16 outside the printer body 11. The printed tape portion 30 is then cut and separated by the cutter 32 of FIG. 2 from the remaining tape.

Figure 4:
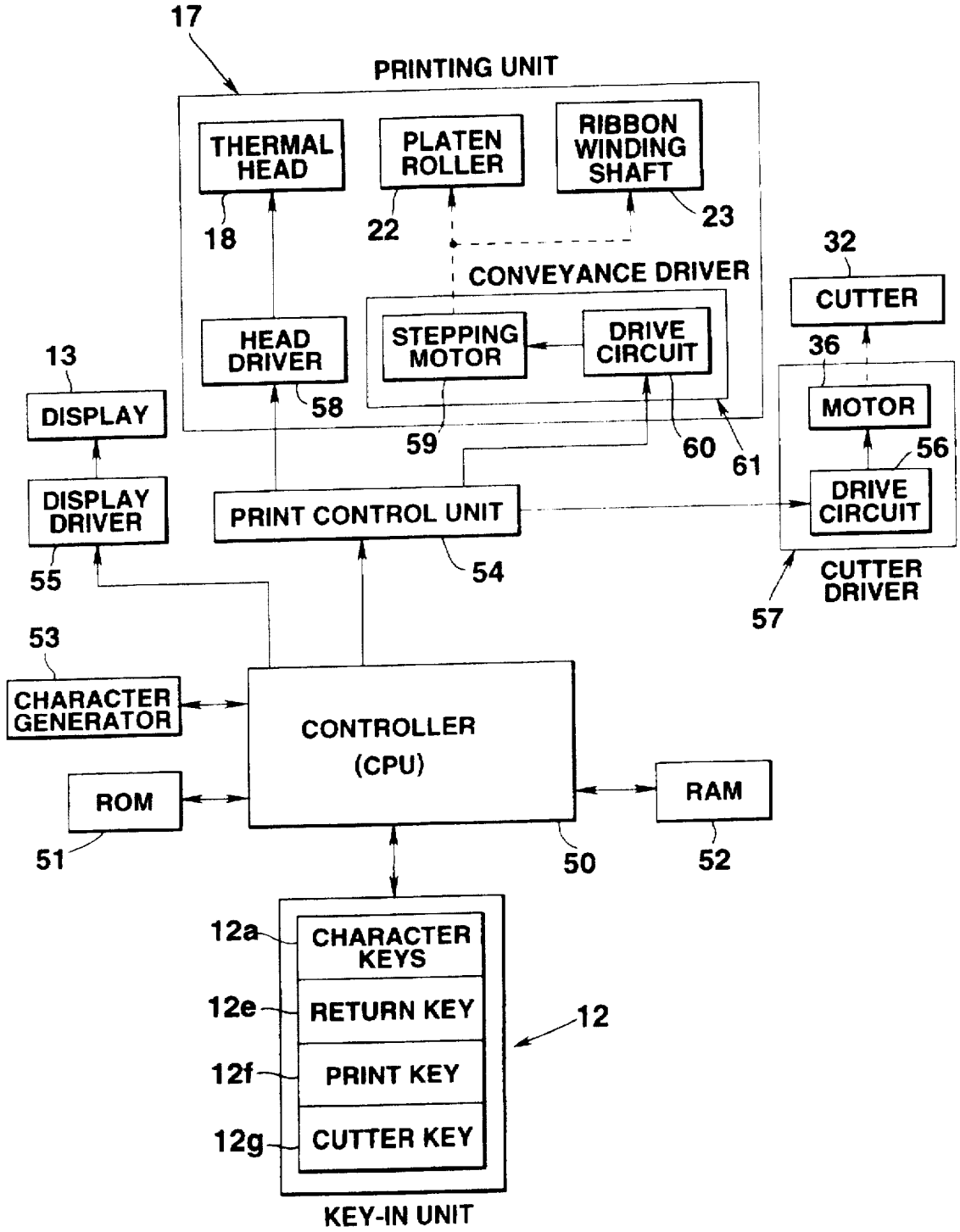
FIG. 4 is a block diagram indicative of an electronic circuit of the tape printer.

FIG. 4 is a block diagram indicative of the structure of the electronic circuit of the inventive tape printer. The electronic circuit of the tape printer includes a controller (CPU) 50, which starts up a system program stored beforehand in a ROM 51 in accordance with a key-in signal from the keyboard 12 and controls the respective operations of the elements of the circuit.

The controller 50 is connected to the keyboard 12, a ROM 51, a RAM 52, and a character generator 53, the printing unit 17 via a print control unit 54, a display 13 via a display driver 55, and a cutter driver 57 which includes a driving motor 36 for the cutter 32 and a driver 56 for the motor 36.

The printing unit 17 is provided with the thermal head 18 and a thermal head driver 58 which drives the thermal head 18, and a tape/ink ribbon conveyance driver 61 which includes a stepping motor 59 connected via a gear-train transmission mechanism to the platen roller 22 and ink ribbon winding shaft 23 for driving the elements 22 and 23, and a drive circuit 60 for the stepping motor 59. The conveyance driver 61 conveys the tape 30 and the ink ribbon 31 by a predetermined length each time one-line heating elements of the thermal head 18 are driven to produce heat.

ROM 51 contains system control programs for the controller 50 such as a control program for inputting text data in various modes and a printing control program.

The character generator 53 contains character pattern data for all characters/symbols/command codes keyable in by the key-in unit 12.

Figure 5:
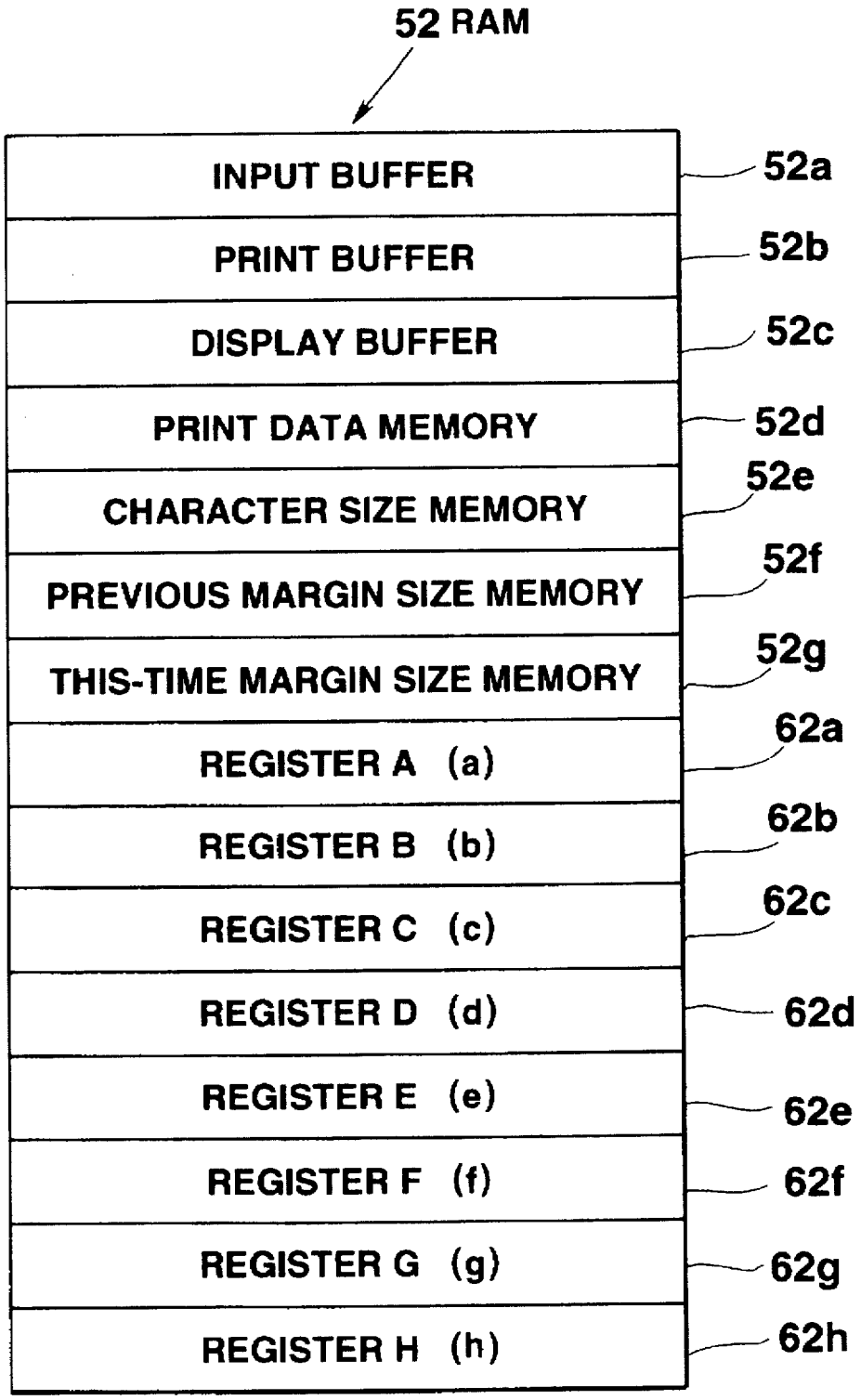
FIG. 5 shows the layout of a RAM of the tape printer.

FIG. 5 shows the data register layout of RAM 52 of the tape printer. RAM 52 is provided with an input buffer **52*a*, a print buffer 52*b*, a display buffer 52*c*, a print data memory 52*d*, a character size memory 52*e*, a previous margin size memory 52*f*, a this-time margin size memory 52*g*, and registers A 62*a*–H 62*h***.

The input buffer **52*a* stores keyed-in data from the key-in unit 12** in the form of a character code or a control code.

The print buffer **52*b* stores print data for one line corresponding to the line-like dot heating elements of the thermal head 18**.

The display buffer **52*c* stores character pattern data corresponding to keyed-in text data read from the character generator 53 to display the keyed-in text data on the display 13**.

The print data memory **52*e*** stores text data, to be printed, in the form of a bit map.

The character size memory **52*e*** stores data on the sizes of the respective characters composing text data, to be printed, as 1×1 (full size) and 2×2 (double size).

The previous and this-time margin size memories **52*f* and 52*g* store data on an appropriate one of three kinds of margin sizes X, Y and O (X>Y>O) set selectively for each text data to be printed. Data on the margin size (X, Y or O) set for the text data to be printed this time is stored in the this-time margin size memory 52*g*. Data on the margin size stored in the this-time margin size memory 52*g* is shifted to and stored in the previous margin size memory 52*f*** as the this-time printing ends and the text data to be printed next is input.

The lengths of the margins X and Y to be set are determined so as to be smaller than the distance L between the thermal head 18 and the cutter 32.

The register A **62*a*** stores data on the calculated print line count a of text data to be printed this time.

The register B **62*b* stores data on the actual line count b printed and output by the thermal head 18** this time and counted up one as the one line data is printed and output.

The register C **62*c* stores data on a feed quantity c of the tape 30** involved in the printing as a conveyance line count in the printing operation corresponding to the step count of the conveyance motor.

The register D **62*d* stores data on a margin size d (=X, Y or O) set for the text data to be printed this time stored in the this-time margin size memory 52*g*** and to be printed this time.

The register E **62*e* stores data on a margin size e set for the text data in the previous printing and shifted from the register D 62*d***.

The register F **62*f* stores data on a leading cut position f calculated in accordance with Expression (1) below to detect that the tape 30 has been conveyed to the position of the cutter 32 with the tape 30** having left at its leading end a margin corresponding to the this-time margin size d when this-time printing has been performed:

$$\text{Leading cut position } f=L-d \qquad \text{Expression (1)}$$

where L is the fixed distance between the printing position P of the thermal head 18 and the tape cut position C of the cutter 32.

The register G **62*g* stores data on a trailing end cut position g calculated in accordance with Expression (2) below to detect that the tape 30 has been conveyed to the position of the cutter 32 with the tape 30** having left at its trailing end a margin corresponding to the this-time margin size d when the final text data has been printed:

$$\text{Trailing end cut position } g=L+a+d \qquad \text{Expression (2).}$$

The register H **62*h* stores data on a set continuous margin h calculated in accordance with Expression (3) below to detect that when the previous text data has been printed and there is text data to be printed next, the tape 30** has been conveyed to the this-time print starting position with margins corresponding to the previous and this-time margin sizes e and d being set:

$$\text{Set continuous margin } h=e+d \qquad \text{Expression (3).}$$

The operation of the inventive tape printer will be described next.

Figure 6:
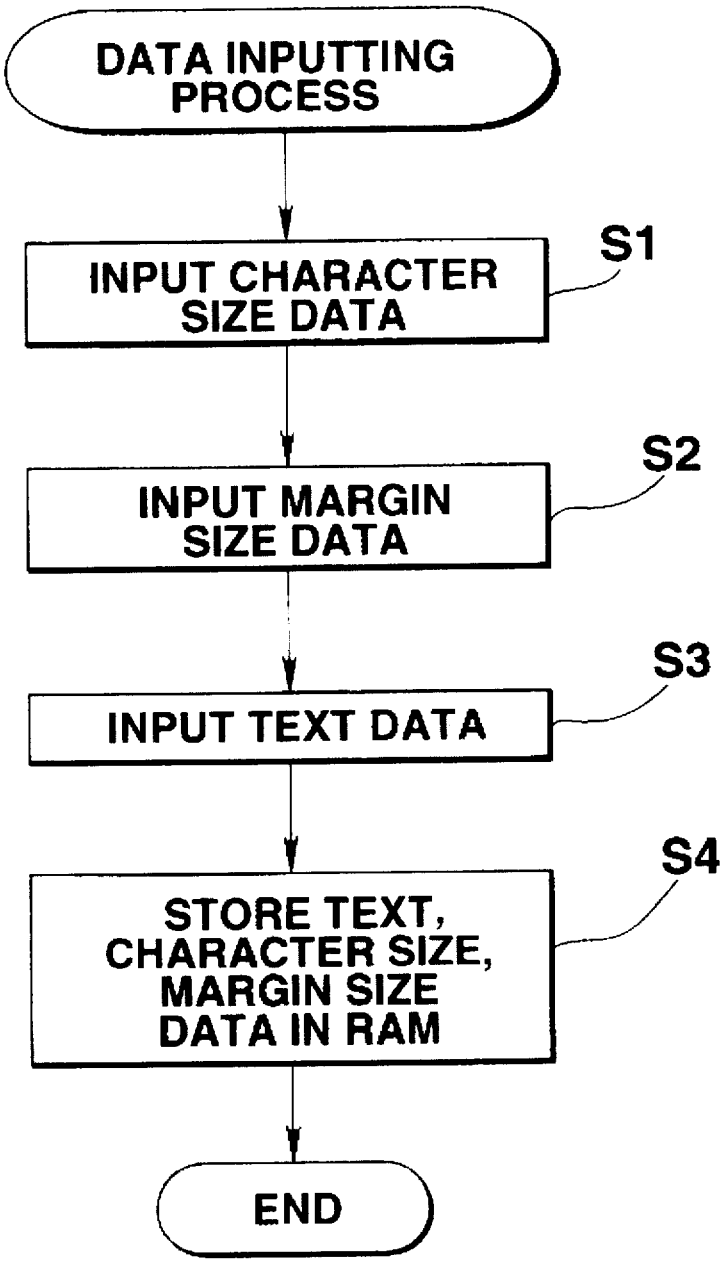
FIG. 6 is a flow chart indicative of a data inputting process performed by the printer.

FIG. 6 is a flow chart indicative of a data inputting process performed by the tape printer.

When the controller 50 is set in the data input mode to input text data to be printed, the display 13 displays thereon a screen which urges the operator to set the size of characters which compose the text data to be input (step S1).

In this screen, when the operator operates the key-in unit 12 to select a desired character size as a standard one (1×1) or a double-wide size (1×2) and then operates the return key **12*e*, the display 13** then displays thereon a screen which urges the operator to set margin sizes to be provided at the leading and trailing ends of the text data (steps S1, S2).

In this screen, when the operator operates the key-in unit 12 to select a desired one of the margin sizes "X", "Y" or "O" (L>X>Y>O) and then operates the return key **12*e*, the display 13** then displays thereon a screen which urges the operator to input text data (steps S2, S3).

In this screen, then the operator operates the character input keys **12*a* of the key-in unit 12 to input and display desired text data, and then operates the return key 12*e* to command the entry of the respective input data, the character size data (for example, "1×1") selected at step S1 is stored in the character size memory 52e of RAM 52, the margin size data (for example, "X") selected at step S2 is stored in the this-time margin size memory 52g, and the text data (for example, "ABCD") input and fixed at step S3 is stored in the input buffer 52a of RAM 52** (step S4).

Figure 7:
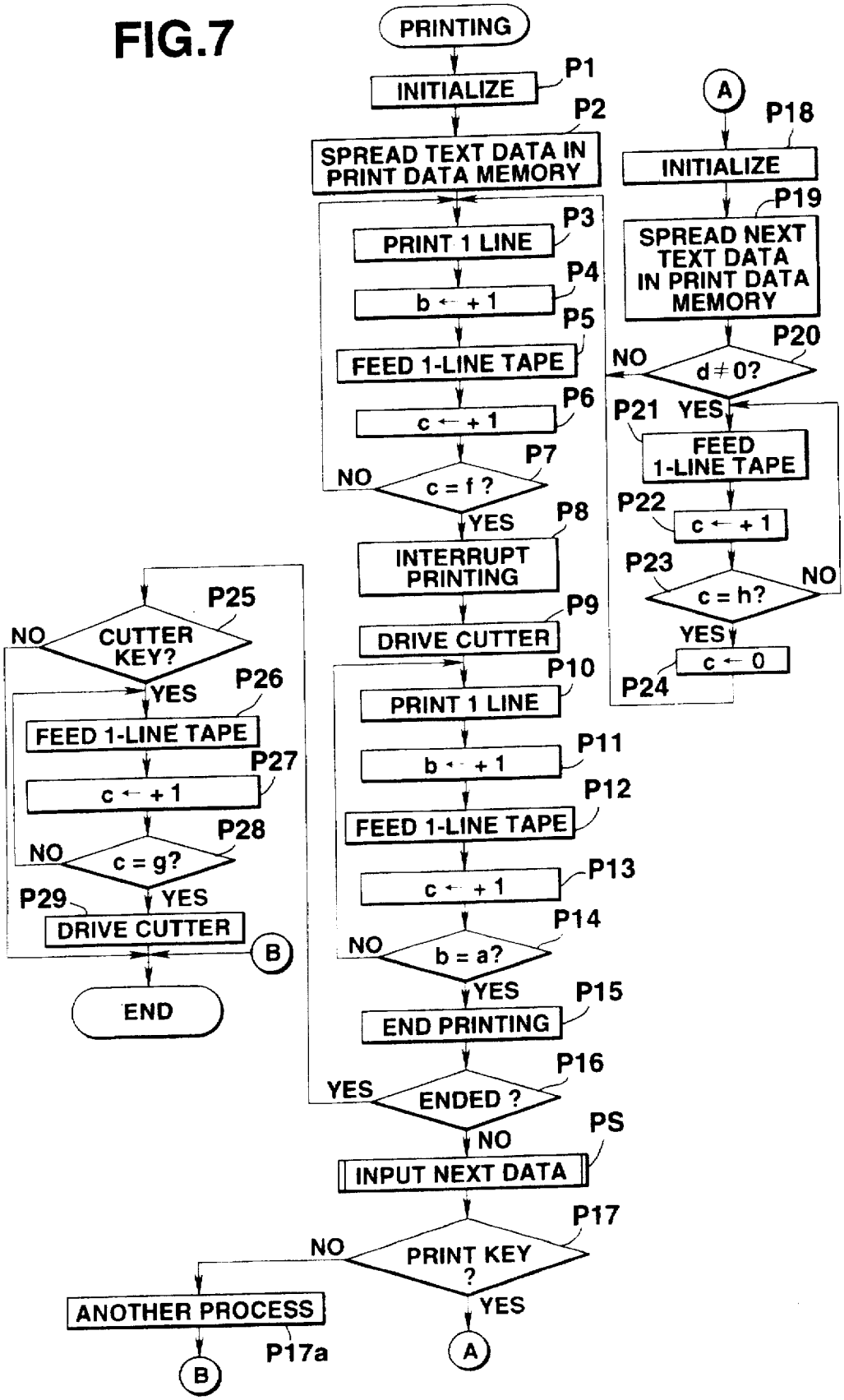
FIG. 7 is a flow chart indicative of a printing process performed by the tape printer.

When in this state the print key 12f of the key-in unit 12 is operated, the printing process for the text data is started up in accordance with a flow chart of FIG. 7.

FIGS. 8A–8H illustrate the printed state of the text data appearing as the printing operation of the tape printer proceeds.

When the controller 50 is set in the printing mode, the print buffer 52b, print data memory 52d and registers A 62a–H 62h are all cleared in the initializing process and a print line count a for the text data "ABCD" stored in the input buffer 52a and to be printed this time is calculated and its data is stored in the register A 62a. Data on a margin size d (=X) set for the text data "ABCD" stored in the this-time margin size memory 52g and to be printed this time is stored in the register D 62d. In this-time printing, a leading cut position f is calculated in accordance with Expression (1) and its data is stored in the register F 62f to detect that the tape 30 has been conveyed to the position of the cutter 32 with the tape 30 having left at its leading end a margin corresponding to the this-time margin size d=X. A trailing end cut position g is calculated in accordance with expression (2) and its data is stored in the register G 62g to detect that when the text data "ABCD" which is the final one has been printed, the tape 30 has been conveyed to the position of the cutter 32 with the tape 30 having set at its trailing end a margin corresponding to the this-time margin size d (=X) (step P1 and FIG. 8A).

The text data "ABCD" stored in the input buffer 52a is spread and stored as print data in the print data memory 52d on the basis of character size "1×1" data stored in the character size memory 52e (step P2).

In response to this operation, the print data "ABCD" spread in the print data memory 52d is read and transferred one line data at a time to the print buffer 52b, and output from the controller 50 via the print control unit 54 to the thermal head 18 to thereby print one line at a time correspondingly. Thus, the actual print line count b whose data is stored in the register B 62b is counted up by one correspondingly, the ink ribbon winding shaft 23 and the platen roller 22 are rotated by the conveyance driver 61 to convey the tape 30 and the ink ribbon 31 one line width at a time correspondingly. This causes the tape feed quantity c data stored in the register C 62c to be counted up by one correspondingly (steps P3–P6).

Figures 8A, 8B, 8C, 8D, 8E, 8F, 8G, 8H:
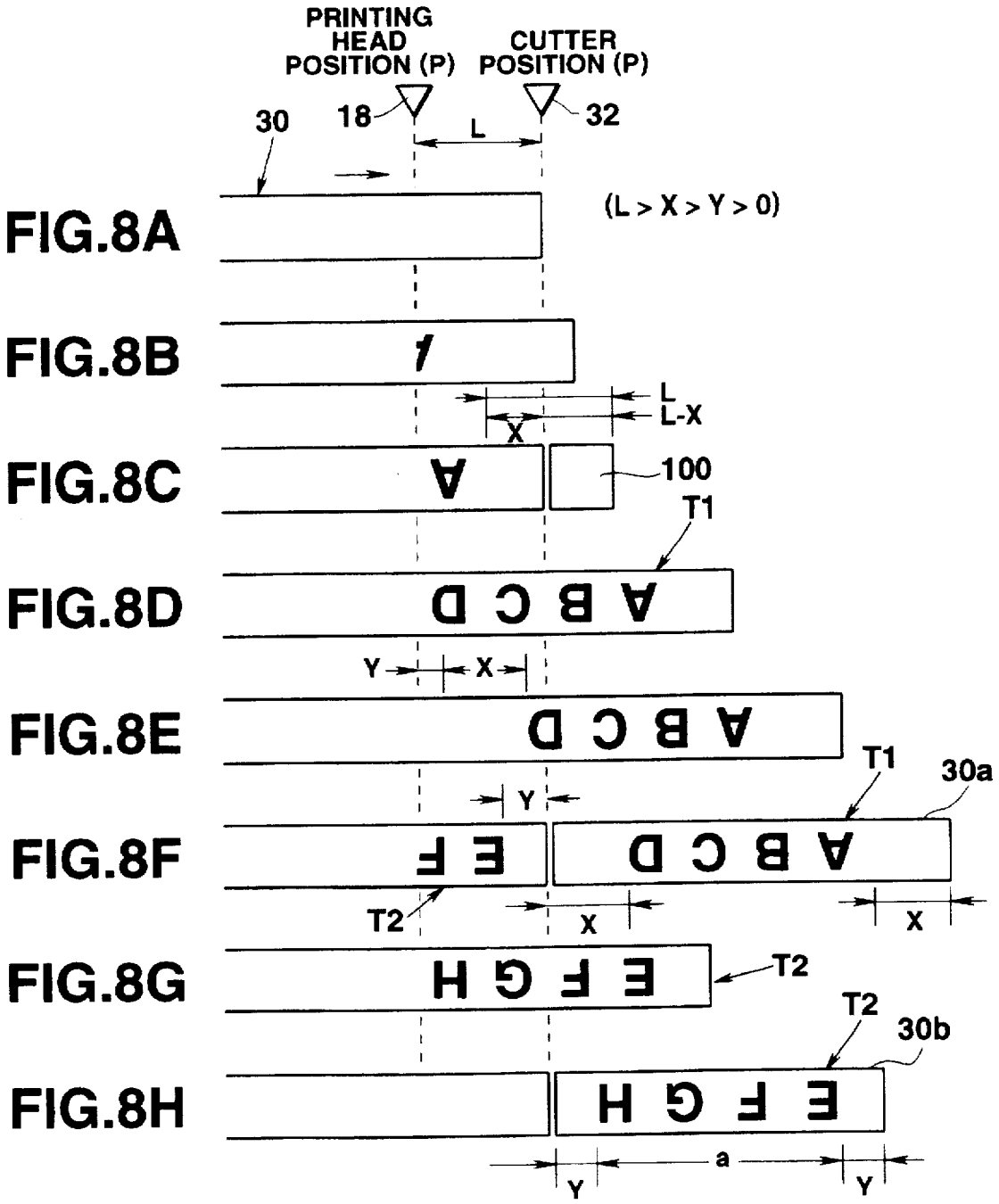
FIGS. 8A, 8B, 8C, 8D, 8E, 8F, 8G, and 8H each illustrate printed text data in the printing process performed by the printer.
Figures 9A, 9B, 9C, 9D, 9E:
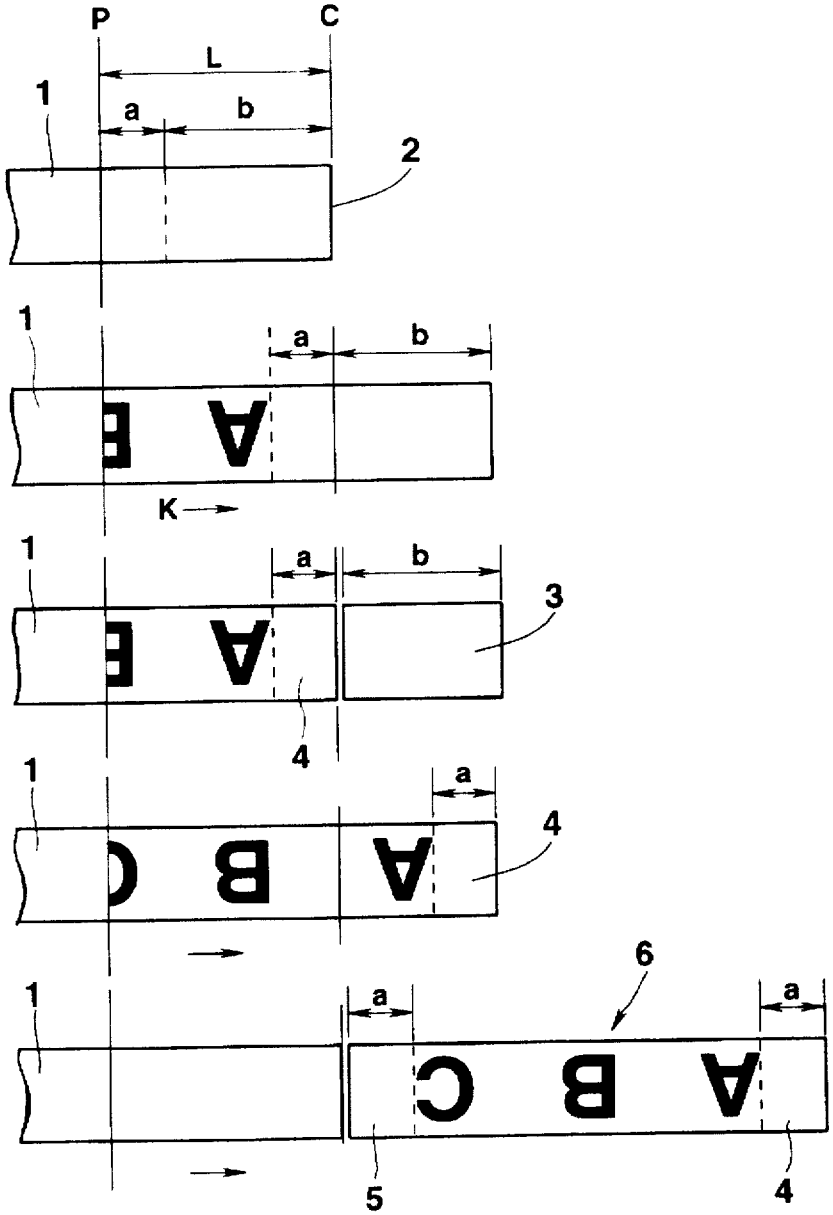
FIG.9A PRIOR ART
FIG.9B PRIOR ART
FIG.9C PRIOR ART
FIG.9D PRIOR ART
FIG.9E PRIOR ART
FIGS. 9A, 9B, 9C, 9D and 9E illustrates text data printed on a tape by the conventional tape printer.

Each time the text data "ABCDE" is printed for one line at steps P3–P6, the controller 50 determines whether the tape feed quantity c counted up in the register C 62c has arrived at a quantity corresponding to the leading cut position f (=L–d) data stored in the initialized register F 62f, that is, whether the tape 30 has been conveyed to the position of the cutter 32 with the tape 30 having left at its leading end a margin corresponding to the this-time margin size d (=X) when the "ABCD" has been printed (step P7 and FIG. 8B).

If so, the one-line printing process at steps P3–P6 is interrupted, the cutter driver 57 is driven to cause the cutter 32 to cut the tape 30 such that a required margin corresponding to the this-time margin size d (=X) is left before the printed tap portion for the character data and that an unnecessary margin portion 100 present before the required margin is separated from the remaining tape 30 (steps P8, P9 and FIG. 8C). In the present invention, the production of an unnecessary margin portion such as 100 occurs only at that time, that is, at the first operation of the cutter 32.

In response to this operation, a one-line printing process similar to the process at steps P3–P6 is restarted to continue to print the text data "ABCD" (steps P10–P13).

Each time the text data "ABCD" is printed one line in the process at steps P10–P13, it is determined whether the actual print line count b counted up in the register B 62b has arrived at the print line count a of the text data "ABCD" stored in the initialized register A 62a, that is, whether the whole "ABCD" has been printed (step P14).

If so, the driving of the thermal head 18, ink ribbon winding shaft 23 and platen roller 22 is stopped to terminate the printing operation of the text data "ABCD" (step P15 and FIG. 8D).

Subsequently, in order to print the next text data, the data inputting process of FIG. 6 is started up and desired text data to be printed next is input (step P16→PS).

Data on the character size (for example, "1×1") selected at step S1 is stored in the character size memory 52e of RAM 52 when the next text data is input in the data inputting process (FIG. 6), data on the margin size (for example, "Y") selected at step S2 is stored in the this-time margin size memory 52g of RAM 52, and the text data (for example, "EFGH") fixed at step S3 is stored in the input buffer 52a of RAM 52 (step PS"S1–S4").

In this case, data on the margin size (X) for the previous text data "ABCD" T1 stored so far in the this-time margin size memory 52g is rewritten and stored in the previous margin size memory 52f.

When the print key 12f of the key-in unit 12 is operated to print the next text data "EFGH" T2 input in the data inputting process of FIG. 6, the printing process of FIG. 7 is restarted (P17).

When the controller 50 is again set in the printing mode by this restarted printing process, the contents of the print buffer 52b, print data memory 52d and registers A 62a–H 62h of RAM 52 are all cleared in the initializing process, and the print line count a of the text data "EFGH" T2, to be printed this time, stored in the input buffer 52a is calculated and its data is stored in the register A 62a. Data on a margin size d (=Y) set for the text data "EFGH" T2 stored in the this-time margin size memory 52g and to be printed this time is stored in the register D 62d. Data on a margin size (X) for the previous text "ABCE" data T1 stored so far in the register D 62d is stored as the previous margin size e (=X) in the register E 62e. Data on the leading cut position f is calculated in accordance with Expression (1) and stored in the register F 62f to detect that the tape 30 has been conveyed to the position of the cutter 32 with the tape 30 having left at its leading end a margin corresponding to the this-time margin size d (=Y) in the this-time printing. A trailing end cut position g is calculated in accordance with the Expression (2) and its data is stored in the register G 62g to detect that when the text data "EFGH" is the last one which has been printed, the tape 30 has been conveyed to the position of the cutter 32 with the tape having set at its trailing end a margin corresponding to the this-time margin size d (=Y). A set continuous margin h is calculated in accordance with the Expression (3) and its data is stored in the register H 62h to detect that the tape 30 has been conveyed to the position where the tape starts to be printed this time with margins corresponding to the margin sizes e (=Y) and d (=Y) set previously and this time, respectively, being set (step P18).

The next text data "EFGH" T2 stored in the input buffer 52a is spread and stored as print data in the print data memory 52d on the basis of the character size "1×1" data stored in the character size memory 52e (step P19).

When the controller 50 determines that the this-time margin size d (=Y) whose data is stored in the register D 62d is not "0", the ink ribbon winding shaft 23 and platen roller 22 are rotated by the conveyance driver 61 from the time when the printing of the previous text data "ABCD" T1 has been completed, as shown in FIG. 8D, to start the conveyance of the tape 30 and ink ribbon 31 one line width at a time to thereby count up correspondingly by one the tape feed quantity c whose data is stored in the register C 62c (step P20→P21, P22).

Each time the tape 30 and the ink ribbon 31 are conveyed one line width a time in the process at steps P21 and P22, the controller 50 determines whether the tape feed quantity c counted up in the register C 62c has arrived at the set continuous margin h (=e+d) whose data is stored in the initialized register H 62h, that is, whether the tape 30 has been conveyed to the position where the next text data "EFGH" T2 starts to be printed with the tape 30 having set after the previous text data "ABCD" T1 margins corresponding to the previous margin size e (=X) and the this-time margin size d (=Y) (step P23 and FIG. 8E).

If so, data on the tape feed quantity c stored in the register C 62c is cleared to become "0" (step P24).

In response to this operation, the print data "EFGH" spread in the print data memory 52e is read and transferred one line data at a time to the print buffer 52b, and output from the controller 50 via the print control unit 54 to the thermal head 18 to thereby print the corresponding one line. Thus, the actual print line count b whose data is stored in the register B 62b is counted up one at a time, and the ink ribbon winding shaft 23 and the platen roller 22 are rotated by the conveyance driver 61 to convey the tape 30 and the ink ribbon 31 one line width at a time. Thus, the tape feed quantity c whose data is stored in the register C 62c is counted up by one correspondingly (steps P3–P6).

Each time the text data "EFGH" is printed for one line at steps P3–P6, the controller 50 determines whether the tape feed quantity c counted up in the register C 62c has arrived at a quantity corresponding to the leading cut position f (=L−d) whose data is stored in the register F 62f, that is, whether the boundary between a margin corresponding to the previous margin size e (=X) and left after the printed previous data "ABCD" T1 and a margin corresponding to the this-time margin size d (=Y) and left before the next text data "EFGH" T2 to be printed has been conveyed to the position of the cutter 32 (step P7).

If so, the one-line printing process at steps P3–P6 is interrupted and the cutter 32 is driven by the cutter driver 57 to cut the tape 30 such that the tape portion where the previous text data "ABCD" T1 has been printed is separated as a label 30a from the remaining tape 30 with a margin corresponding to the previous margin size e (=X) set at each of the leading and trailing ends of the previous text data "ABCD" T1 and with the printed portion where the this-time text data "EFGH" T2 is printed having left at its leading end a required margin corresponding to the this-time margin d (=Y) (steps P8, P9 and FIG. 8F).

In response to this operation, a one-line printing process similar to the process at steps P3–P6 is restarted to continue to print the next text data "EFGH" T2 (steps P10–P13).

Each time the text data "EFGH" is printed one line in the process at steps P10–P13, the controller 50 determines whether the actual printed line count b counted up in the register B 62b has arrived at the print line count a of the text data "EFGH" stored in the initialized register A 62a, that is, whether the whole text data "EFGH" has been printed (step P52).

If so, the driving of the thermal head 18, ink ribbon winding shaft 23 and platen roller 22 is stopped to thereby terminate the printing operation of the text data "EFGH" (step P15 and FIG. 8G).

If there is no further next text data to be printed after the previous text data "ABCD" T1 and the next text data "EFGH" T2 have been printed successively and the cutter key 12g of the key-in unit 12 is operated, the ink ribbon winding shaft 23 and platen roller 22 are rotated by the conveyance driver 61 from the time when the text data "EFGH" T1 has been printed, as shown in FIG. 8G, to start the conveyance of the tape 30 and ink ribbon 31 one line width at a time to thereby count up correspondingly by one the tape feed quantity c whose data is stored in the register C 62c (step P16→P25→P26, P27).

Each time the tape 30 and the ink ribbon 31 are conveyed one line width in the process at steps P26 and P27, the controller 50 determines whether the tape feed quantity c counted up in the register C 62c has arrived at the trailing end cut position g (=L+a+d) data corresponding to the end text data stored in the initialized register G 62g, that is, whether the tape 30 has been conveyed to the position of the cutter 32 with a margin corresponding to the this-time margin size d (=Y) being left after the printed end text data "EFGH" portion (step P28).

If so, the cutter 32 is operated by the cutter driver 57 to cut the tape 30 such that the tape portion where the text data "EFGH" has been printed is separated as a label 30b from the tape 30 with the this-time margin size d (=Y) being set at each of the leading and trailing ends of the text data (step P29 and FIG. 8H).

Thus, according to the inventive tape printer, two successive different text data, for example, "ABCD" and "EFGH", with corresponding set desired margins "X" and "Y" are printed on the tape 30. In this case, when the first text data "ABCD" has been printed, the tape 30 is fed by a continuous margin "X+Y" and then the second text data "EFGH" starts to be printed. When the boundary between the successive margins "X" and "Y" arrives at the position of the cutter 32 during the printing of the second text data, the printing of the second text data is interrupted and the printed first text data "ABCD" portion is cut and separated from the remaining tape 30 with the data "ABCD" having the margin "X" at each of the leading and trailing ends thereof, and the second text data "EFGH" starts then to be printed. Thus, no useless tape 30 portion is produced between the successive text data printed on the tape to thereby achieve economical printing.

By operating the cutter key 12g of the key-in unit 12 when the second text data "EFGH" has been printed, the tape 30 is conveyed to the portion where the margin "Y" is left after the text data "EFGH" and cut and separated by the cutter 32 from the remaining tape.

What is claimed is:

1. A tape printer comprising:

an input section for separately inputting at least first and subsequent second text data, each of any characters, to the tape printer;

a printing section comprising a printing head for printing the inputted first and second text data separately on a tape, and a conveyance section for conveying the tape;

a print commanding section operated by an operator for commanding said printing section to separately print the first and second text data inputted by said input section on the tape while conveying the tape;

a cutter, provided at a position spaced a predetermined distance downstream from said printing head in the direction of conveyance of the tape, for cutting the tape;

a margin setting section for setting a margin at each of leading and trailing ends of each of the first text data at a distance shorter than a predetermined distance when the first and second text data are separately printed on the tape;

determining means for determining whether said print commanding section has commanded said printing section to print the second text data inputted by said input section after said printing section has printed the first text data inputted by said input section;

calculation means, responsive to said determining means determining that said print commanding section has commanded said printing section to print the second text data, for calculating a position on the tape where the printing and conveying operations of said printing section are interrupted, on the basis of a length of a margin set by said margin setting section for each of the first and second text data printed by said printing section and the predetermined distance between said printing head and said cutter section; and control means for interrupting a printing of the second text data by said printing section at the calculated position on the tape during the printing of the second text data, and for driving said cutter section to cut a tape portion on which the first text data present downstream from the second text data under printing is printed from a remaining portion of the tape.

2. A tape printer according to claim 1, wherein:

said printing section comprises a thermal printer; and said printing head comprises a thermal head which thermally transfers the first and second text data through an ink ribbon to the tape.

3. A tape printer according to claim 2, wherein:

said thermal head comprises a plurality of heating elements arranged in a line across the tape; and said thermal printer comprises print pattern data producing means for producing print pattern data corresponding to the respective first and second text data inputted by said input section, and printing head driving means for driving the plurality of heating elements of said thermal head on the basis of the print pattern data produced by said print pattern data producing means, and wherein said conveyance section conveys the tape a predetermined distance each time a printing operation of the plurality of heating elements of said thermal head is performed.

4. A tape printer according to claim 1, wherein said conveyance section comprises:

a rotatable platen roller against which said printing head is pressed through the tape; and a driving section for rotating said platen roller.

5. A tape printer according to claim 1, further comprising a display section for displaying the first and second text data input by said input section.

6. A tape printer according to claim 1, further comprising:

a cutter drive commanding section operated by the operator for issuing a command to drive said cutter; and second control means responsive to the command issued by said cutter drive commanding section after said printing section has printed the second text data, for causing said printing section to convey the tape by the length of the margin set by said margin setting section and for then driving said cutter.

* * * * *